US005634571A

United States Patent [19]

Cataneo et al.

[11] Patent Number: 5,634,571

[45] Date of Patent: Jun. 3, 1997

[54] APPARATUS FOR DISPENSING TWO SPRAYABLE SUBSTANCES IN A USER SELECTABLE RATIO

[75] Inventors: Ralph J. Cataneo, Brooklyn, N.Y.; Robert J. Tannenbaum, Freehold, N.J.

[73] Assignee: Innavision Services, Inc., Clifton, N.J.

[21] Appl. No.: 478,589

[22] Filed: Jun. 7, 1995

[51] Int. Cl.[6] ..... B67D 5/56

[52] U.S. Cl. ..... 222/80; 222/134; 222/135; 222/136; 222/144.5; 222/145.8; 222/386.5; 222/389; 239/304

[58] Field of Search ..... 222/80, 134, 135, 222/136, 144.5, 145.1, 145.7, 145.8, 386.5, 389; 239/304, 305

[56] References Cited

U.S. PATENT DOCUMENTS

| | | | |
|---|---|---|---|
| 3,236,418 | 2/1966 | Dalle et al. | 222/135 |
| 3,272,387 | 9/1966 | Katz et al. | 222/144.5 X |
| 3,303,970 | 2/1967 | Breslau et al. | 222/135 X |
| 3,575,319 | 4/1971 | Saifianoff | 222/135 |
| 3,704,812 | 12/1972 | Marand | 222/136 |
| 3,813,011 | 5/1974 | Harrison et al. | 222/136 |
| 4,773,562 | 9/1988 | Guret | 222/135 |
| 4,880,143 | 11/1989 | Murray et al. | 222/135 |
| 4,958,750 | 9/1990 | Palmert et al. | 222/135 |
| 5,005,736 | 4/1991 | Portas | 222/135 |
| 5,009,342 | 4/1991 | Lawrence et al. | 222/145.7 X |
| 5,385,270 | 1/1995 | Cataneo et al. | 222/134 |
| 5,568,883 | 10/1996 | Cataneo et al. | 222/145.8 X |

*Primary Examiner*—Kevin P. Shaver

*Attorney, Agent, or Firm*—Panitch Schwarze Jacobs & Nadel, P.C.

[57] ABSTRACT

An apparatus for dispensing two sprayable substances in a user selectable ratio. The dispensing apparatus comprises first and second pressurized containers for holding first and second sprayable substances. The dispensing apparatus further includes a manifold member having first and second inlet openings and an outlet opening. The inlet openings receive the dispensing ends of the first and second pressurized containers. The manifold member includes two passages which are in fluid communication between the first and second inlet openings and the outlet opening, respectively. A selector member having a single opening extending therethrough is provided in fluid communication with the first and second passages in the manifold member. The selector member is selectably rotatable with respect to the outlet opening in the manifold member. An actuator is provided for dispensing the sprayable substance from the apparatus with the ratio of the dispensed substance being selectably variable by the user from 100% of the first sprayable substance and 0% of the second sprayable substance in the first position to 0% of the first sprayable substance and 100% of the second sprayable substance when the selector member is in the second position, to any desired ratio therebetween when the selector member is in an intermediate position.

8 Claims, 3 Drawing Sheets

APPARATUS FOR DISPENSING TWO SPRAYABLE SUBSTANCES IN A USER SELECTABLE RATIO

FIELD OF THE INVENTION

The present invention relates to an apparatus for co-dispensing two sprayable substances. More particularly, the present invention is directed to a dispenser for holding, selecting and co-dispensing a mixture of two sprayable substances in a user selectable ratio.

BACKGROUND OF THE INVENTION

In certain consumable product applications, it is desirable to provide a mixture of two different sprayable substances. Products such as adhesives and paints often require two substances to be mixed together immediately prior to application, with the ratio of the substances to be applied either set at a predetermined level or adjusted to suit particular conditions or applications.

Where the mixture was heretofore preferably applied by spraying, a user without professional spray equipment could not generally spray the mixture onto the article to be coated and was generally required to use a less desired method of application, such as a brush. For example, in epoxy paint systems, a hardener is mixed with a base-paint material immediately prior to application. The mixture cannot be packaged and sold in a single cavity container due to the limited useful life after the components are mixed. A user without equipment for spraying the epoxy paint mixture would be forced to brush the coating onto the surface to be finished, generally achieving a lower quality finish in comparison to a sprayed finish.

In other applications, such as adding additives to paint to accelerate or decelerate drying time or to compensate for atmospheric moisture, it is often necessary to use different proportions of the additive to the base paint mixture. The known methods for preparing and spraying such mixtures requires professional spray equipment with a separate spray gun and a compressor in order to spray on a mixture of the two components with the proportions of the components being hand-mixed by the user.

Dispensing units having multiple chambers for holding different substances in a user selectable ratio for substances such as pastes, liquids or powdered substance are known in the art. However, none of the known prior art multi-chamber dispensing units are suitable for dispensing two sprayable substances under pressure in a user selectable ratio.

The present invention is a result of the observation of the limitations inherent in the known prior art dispensers and efforts to provide an apparatus for dispensing two sprayable substances in a user selectable ratio.

SUMMARY OF THE INVENTION

Briefly stated, the present invention is an apparatus for dispensing two sprayable substances in a user selectable ratio. The dispensing apparatus comprises a first pressurized container for holding a first sprayable substance, with the container including a dispensing end. The apparatus further includes a second pressurized container for holding a second sprayable substance, with the second container including a dispensing end. The dispensing apparatus further includes a manifold member having first and second inlet openings and an outlet opening. The inlet openings are configured for removably receiving the dispensing ends of the first and second pressurized containers. The manifold member includes two passages. The first passage is in fluid communication between the first inlet opening and the outlet opening, and the second passage is in fluid communication between the second inlet opening and the outlet opening. A selector member is provided in fluid communication with the first and second passages in the manifold member. The selector member has a single opening of a predetermined size and predetermined shape extending therethrough. The selector member is selectably rotatable with respect to the outlet opening in the manifold member from a first position, in which the selector member opening is in fluid communication with the first passage, with the second passage being blocked by the selector member, through a plurality of intermediate positions, in which the opening of the selector member is in fluid communication with portions of both passages with the remaining portions of both of the passages being blocked by the selector member, to a second position, in which the opening of the selector member is in fluid communication with the second passage and the first passage is blocked by the selector member. The dispensing apparatus further includes an actuator having an inlet opening in communication with the selector member and an outlet opening whereby, upon activation of the actuator a predetermined measure of sprayable substance is dispensed from the apparatus with the ratio of the dispensed substance being selectably variable by the user from 100% of the first sprayable substance and 0% of the second sprayable substance when the selector member is in the first position, to 0% of the first sprayable substance and 100% of the second sprayable substance when the selector member is in the second position, to any desired ratio therebetween when the selector member is in an intermediate position.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF PREFERRED EMBODIMENT

Figure 1:
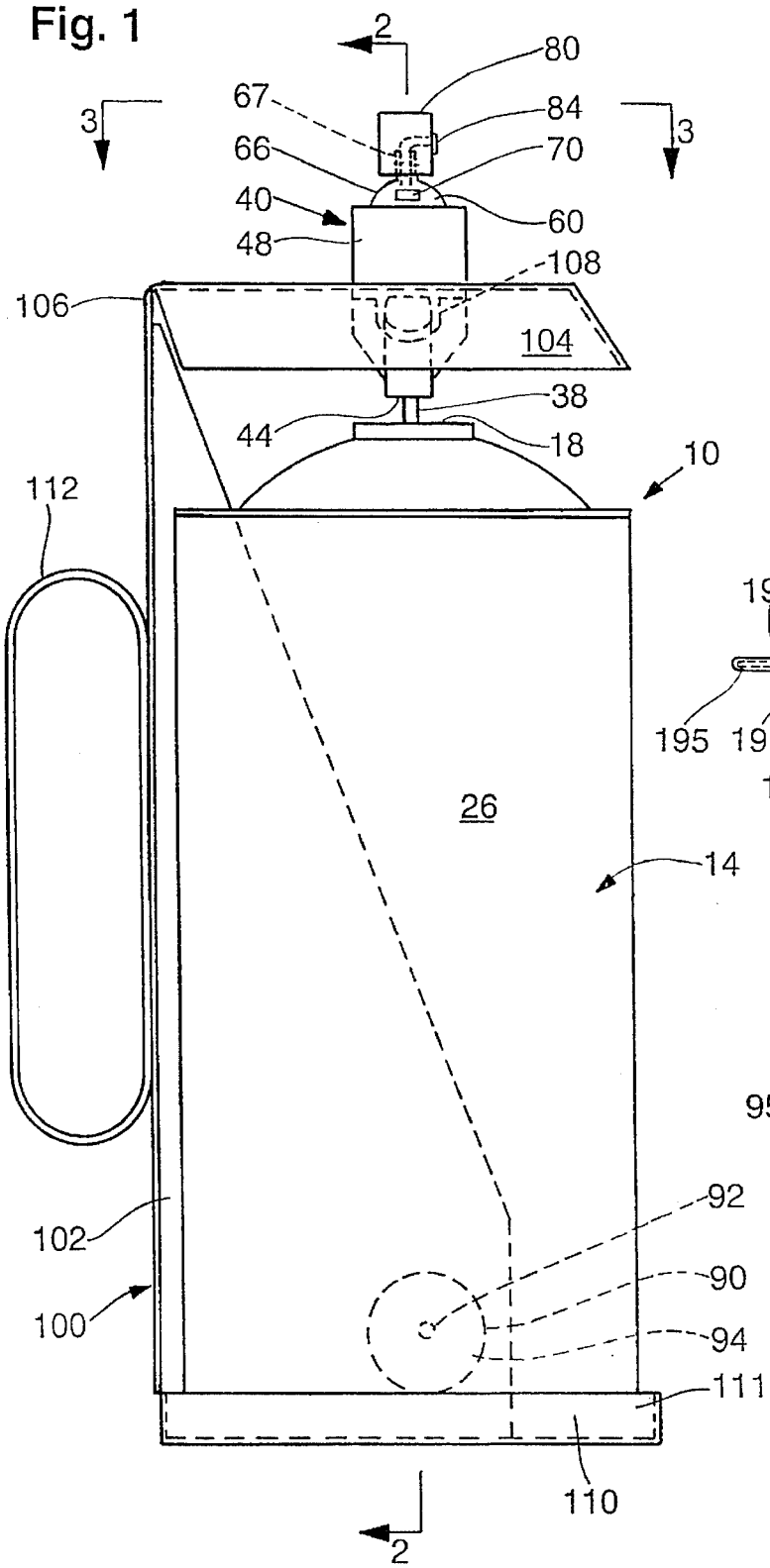
FIG. 1 is a side elevational view of an apparatus for dispensing two sprayable substances in a user selectable ratio in accordance with the present invention.

Certain terminology is used in the following description for convenience only and is not limiting. The words "right,"

"left," "lower" and "upper" designate directions in the drawings to which reference is made. The words "inwardly" and "outwardly" refer to directions toward and away from, respectively, the geometric center of the apparatus for dispensing two sprayable substances in a user selectable ratio and designated parts thereof. The terminology includes the words above specifically mentioned, derivatives thereof and words of similar import.

Referring to the drawings, wherein like numerals indicate like elements throughout, there is shown in FIGS. 1–7 a preferred embodiment of an apparatus for dispensing two sprayable substances in a user selectable ratio, generally designated 10 (hereinafter the "dispenser" 10), in accordance with the present invention.

Figure 2:
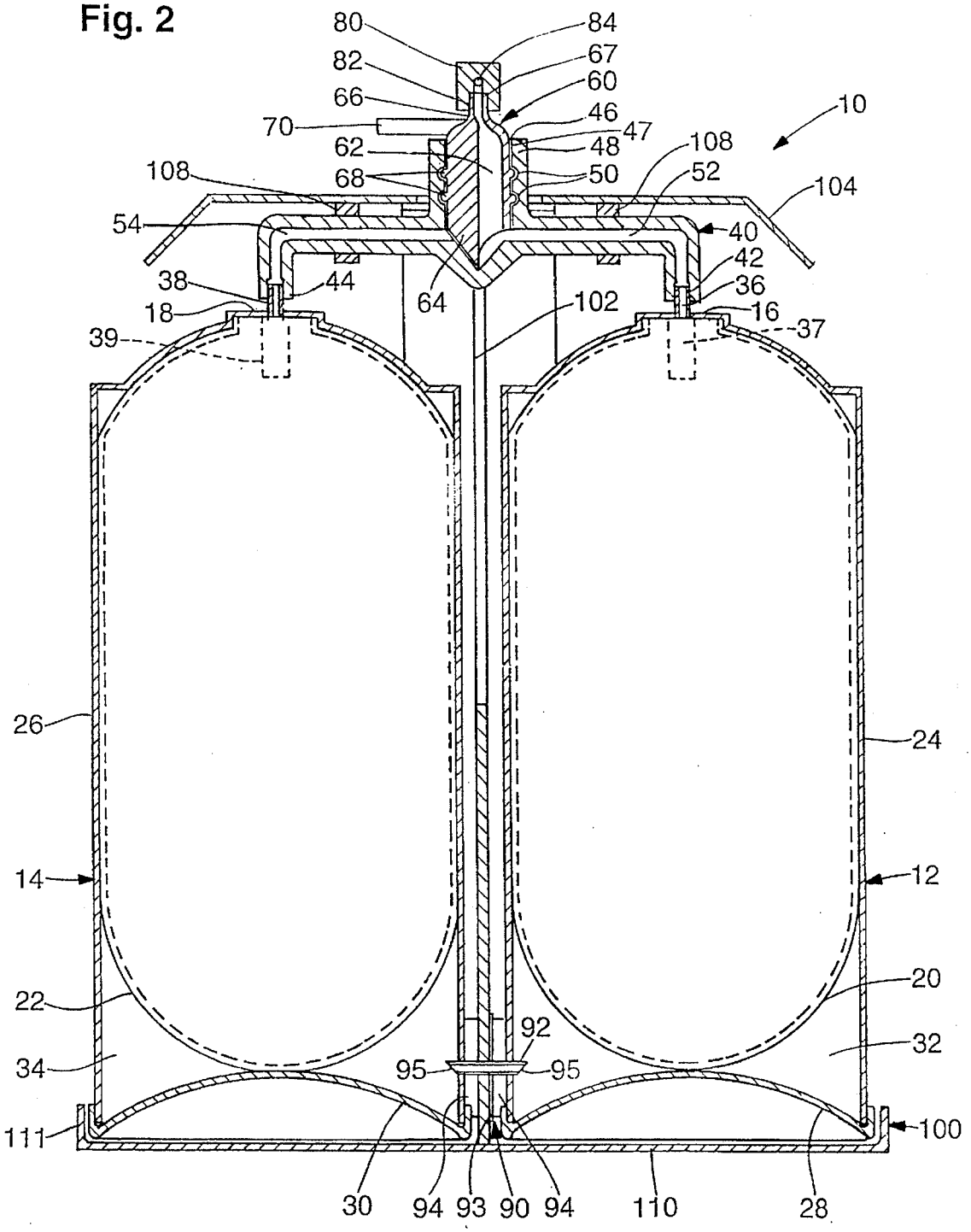
FIG. 2 is a section view taken along line 2—2 in FIG. 1.
Figure 3:
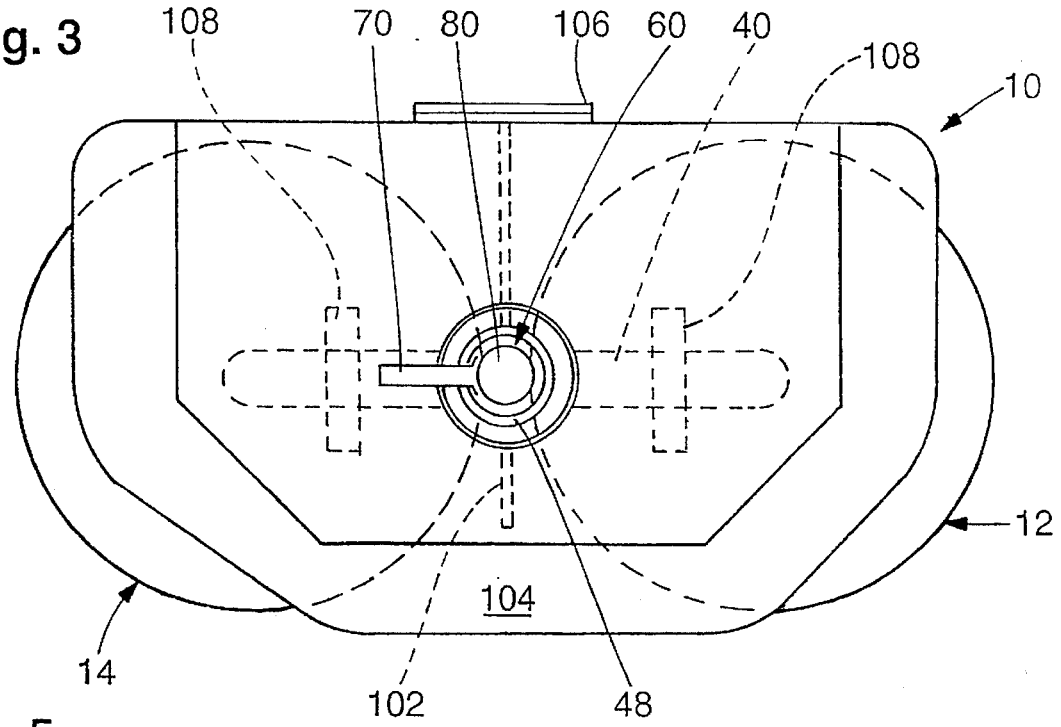
FIG. 3 is a top view taken along line 3—3 in FIG. 1.

As shown in FIGS. 1–3, the dispenser 10 is comprised of a first pressurized container 12 for holding a first sprayable substance (not shown) and a second pressurized container 14 for holding a second sprayable substance (not shown). The first container 12 includes a dispensing end 16 and the second container 14 includes a dispensing end 18. The first pressurized container 12 further includes a first bladder 20, and the first sprayable substance is held preferably within the first bladder 20. The second pressurized container 14 includes a second bladder 22, and the second sprayable substance is preferably held in the second bladder 22. Preferably each container 12, 14 has a side wall 24, 26 which is connected to a respective bottom portion 28, 30.

In the preferred embodiment, a pressurized gas pocket 32, 34 is provided between the bladder 20, 22 and the side wall 24, 26 in the area adjacent to the bottom 28, 30 of each containers 12, 14, respectively. Preferably, a high pressure gas or air is provided in each gas pocket 32, 34 inside each container 12, 14.

Preferably the dispensing end 16, 18 of each container includes a protruding dispensing tube 36, 38 which is in fluid communication with the respective bladder 20, 22, respectively. A valve 37, 39 of the conventional type which is known to those of ordinary skill in the art is provided in fluid communication with the dispensing tubes 36, 38 of the first and second pressurized containers 12, 14 such that when the dispensing tubes 36, 38 are depressed, the valves 37 and 39 are opened to allow the sprayable substances to exit their respective first and second containers 12, 14 through the dispensing tubes 36, 38.

Preferably, the first and second containers 12, 14 are generally cylindrical and are approximately the same size. However, it is understood by those of ordinary skill in the art from the present disclosure that the relative size and cross-section of the containers 12, 14 can be varied, if desired, to suit particular applications. For example, the containers could each be shaped as a parallelepiped and be different sizes. Preferably the containers 12 and 14 are made of a metallic material. However, the containers 12 and 14 may be made of other suitable materials, such as various polymeric materials. In the preferred embodiment, the bladders 20, 22 are preferably made of an elastomeric material which is resistant to the substances contained therein.

Still with reference to FIGS. 1–6, a manifold member 40 having first and second inlet openings 42 and 44 and an outlet opening 46 is shown. The inlet openings 42 and 44 are configured for removably receiving the dispensing end 16 and 18 of the first and second pressurized containers 12 and 14, respectively. Preferably, the inlet openings 42 and 44, are sized for a closed conforming or interference fit with the dispensing tubes 36 and 38 which protrude from the dispensing end 16 and 18 of the first and second containers 12 and 14, respectively. The manifold member 40 further includes two passages 52 and 54. The first passage 52 provides fluid communication between the first inlet opening 42 and the outlet opening 46. The second passage 54 provides fluid communication between the second inlet opening 44 and the outlet opening 46.

In the preferred embodiment, the outlet opening 46 is comprised of a generally circular cavity 47 formed by a circular side wall 48. Two annular recesses 50 are provided on the interior of the side wall 48. In the preferred embodiment, the bottom of the cavity 47 is generally conically shaped.

Preferably, the manifold member 40 is made of a molded polymeric material. However, it is understood by those of ordinary skill in the art from the present disclosure that the manifold member 40 could be made of other materials such as aluminum or steel, and can be formed by various means such as machining, molding or casting, if desired.

Still with reference to FIGS. 1–6, a selector member 60 is provided in fluid communication with the first and second passages 52 and 54 and is positioned in the manifold member 40. Preferably, the selector member 60 is disposed in the cavity 47 of the outlet opening 46. The selector member 60 has a single opening 62 of a predetermined size and a predetermined shape extending therethrough. Preferably, the selector member 60 is generally cylindrical in form and includes a tapered bottom portion 64 formed with a complimentary taper to the tapered bottom portion of the cavity 47 of the manifold outlet opening 46. The top of the selector member 60 includes a transition portion 66 which transitions the body of the selector member 60 down to a tube 67 having a reduced diameter which is approximately the same size as the dispensing tubes 36, 38. The opening 62 extends through the tube 67, the body of the selector member 60 and intersects the tapered bottom portion 64. Preferably, the shape of the opening 62 is semi-circular in cross-section through tapered bottom portion 64 and the main body of the selector member 60 (as shown in FIGS. 2 and 4–6), and transitions to a reduced diameter circular cross-section at the top transition portion 66 of the selector member 60 as it transitions to the tube portion 67 (FIG. 2).

Figure 5:
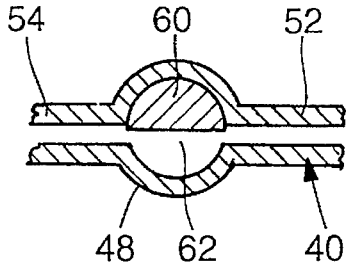
FIG. 5 is a partial section view similar to FIG. 4 showing the selector member in an intermediate position.
Figure 4:
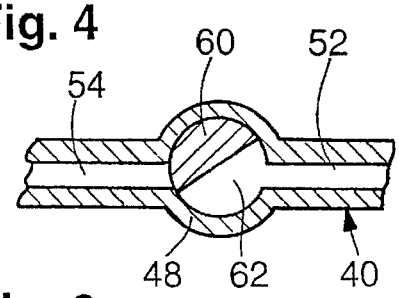
FIG. 4 is a partial section view showing the selector member in a first position.
Figure 6:
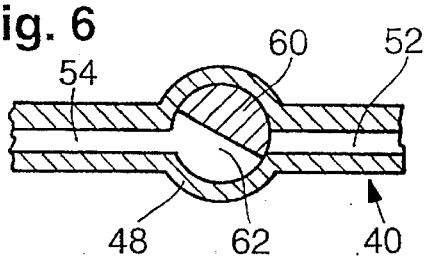
FIG. 6 is a partial section view similar to FIG. 4 showing the selector member in a second position.

The selector member 60 is rotatably mounted in the cavity 47 of outlet opening 46 in the manifold member 40. The selector member 60 is provided with two protruding annular rings 68 which are located in a complimentary position to the annular recesses 50 on the inside of the side wall 48. The selector member 60 is selectably rotatable with respect to the outlet opening 46 in the manifold member 40 from a first position, as shown in FIG. 4 in which the selector member opening 62 is in fluid communication with the first passage 52 with the second passage 54 being blocked by the selector member 60, through a plurality of intermediate positions, one of which is shown in FIG. 5, in which the opening 62 of the selector member 60 is in fluid communication with portions of both of the passages 52 and 54 in the manifold member 40, with the remaining portions of both of the passages 52 and 54 being blocked by the selector member 60, to a second position, as shown in FIG. 6, in which the opening 62 of the selector member 60 is in fluid communication with the second passage 54 of the manifold member 40, and the first passage 52 is blocked by the selector member 60.

Preferably, the selector member 60 is provided with an actuator arm 70 to assist in rotating the selector member 60 in the cavity 47 of the outlet opening 46. In the preferred embodiment, the selector member 60 is made of a polymeric material. However, it is understood by those of ordinary skill in the art from the present disclosure that the selector member 60 can be made of other materials, such as aluminum, brass or steel, if desired, depending on the type of sprayable substances being dispensed, and the selector member 60 may be made by various means such as molding, machining or casting. In the preferred embodiment, the annular rings 68 are formed as a portion of the selector member 60. However, it is recognized by those of ordinary skill in the art from the present disclosure that separate sealing rings, such as O-rings, could be utilized, and grooves (not shown) could be provided in the selector member 60 in a complimentary position to the annular recesses 50 in the inner side wall 48 of the outlet opening 46.

As shown most clearly in FIG. 2, an actuator 80 in the form of a spray nozzle is provided. The actuator 80 has an inlet opening 82 in communication with the selector member 60, and an outlet opening 84. The actuator inlet opening 82 is preferably sized for close conforming fit with the tube portion 67 of the selector member 60. Preferably, the actuator outlet opening 84 is configured as a spray nozzle. Upon activation of the actuator 80, a predetermined measure of the sprayable substance is dispensed from the dispensing apparatus 10 with the ratio of the dispensed substance being selectively variable by the user from 100% of the first sprayable substance and 0% of the second sprayable substance when the selector member 60 is in the first position, as shown in FIG. 4, to 0% of the first sprayable substance and 100% of the second sprayable substance when the selector member is in the second position, as shown in FIG. 6, to any desired ratio therebetween when the selector member is an intermediate position, one of which is shown in FIG. 5.

Preferably, the actuator is made of a polymeric material. However, it is understood by those of ordinary skill in the art from the present disclosure that the actuator 80 could be made of other materials, such as aluminum, brass or other metals, if desired. In the preferred embodiment, the actuator outlet opening 84 is directed at approximately a 90 degree angle from the actuator inlet opening 82. However, it is similarly understood by those of ordinary skill in the art that the relative positions of the actuator inlet and outlet openings 82 and 84 can be varied if desired. For example, the actuator inlet and outlet openings 82 and 84 could be aligned.

Figure 7:
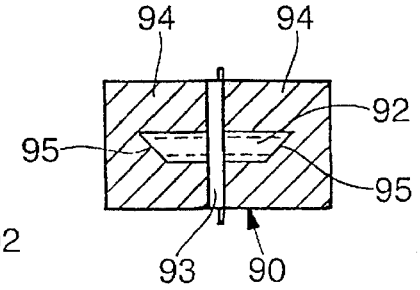
FIG. 7 is a section view of a pressure equalization member in accordance with the present invention.

Referring now to FIGS. 2 and 7, the dispensing apparatus 10 further includes a pressure equalization member 90 located between the first container 12 and the second container 14. The pressure equalization member 90 includes a passage formed by a tube 92, having two end openings 95, which provides fluid communication between the pressurized gas pockets 32 and 34 in the first and second containers 12 and 14. Preferably, the tube 92 has sharp ends 94 which can pierce the side walls 24 and 26 of the first and second containers 12 and 14 at a position below the location of the fully expanded bladders 20 and 22. Seals 94 are located around the tube 92 to create an airtight seal against the side walls 24 and 26 of the first and second containers 12 and 14, respectively. Preferably, a retaining disk 93 is located at a medial portion on the tube 92, to maintain each seal 94 in position on the tube 92.

As shown in FIG. 7 (with the pressure equalization member 90 illustrated in a free state), the seals 94 on the pressure equalization member 90 are sized such that when the pressure equalization member 90 is not installed, each seal 94 expands beyond the end of the tube 90 to seal each end opening 95.

In the preferred embodiment, the tube 92 is made from aluminum or steel, and the seals 94 are made from a closed-cell foam material. However, it is understood by those of ordinary skill in the art from the present disclosure that the tube 92 can be made of other metallic materials, if desired, and the seals 94 may be made of various other polymeric or synthetic materials which made be in the form of a foam or a solid.

Figure 8:
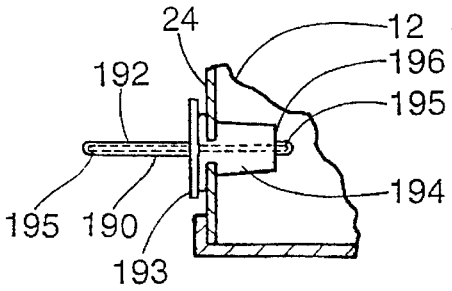
FIG. 8 is a section view of an alternate embodiment of a pressure equalization member in accordance with the present invention.

Referring now to FIG. 8, an alternative embodiment of the pressure equalization member 190 is shown. The pressure equalization member 190 includes a closed end tube 192 having apertures 195 defined through the tube adjacent to each end. A disk 193 is affixed to the tube 192 at a medial position. The first and second containers 12 and 14 are provided with a valve 194 having a self-sealing opening 196 defined therethrough such that the opening 196 remains sealed until the tube 192 is fully inserted. Preferably, the tube 192 is made of a metallic material, such as aluminum or steel, and the valve 194 is an elastomeric needle valve assembly of the type which is known to those of ordinary skill in the art. However, it is understood by those of ordinary skill in the art from the present disclosure that the tube 192 could be made as two separate pieces with a flexible hose connecting the two pieces together, or a single longer bendable metal tube such that the positions of the valves 194 in the containers 12 and 14 would not be critical.

Referring now to FIGS. 1–3, the dispensing apparatus 10 further includes a holder assembly 100. The holder assembly 100 includes a center rib 102 upon which the pressure equalization member 90 is mounted. A hood member 104 is pivotally attached to the center rib 102 by a living hinge 106. The manifold member 40 is attached to the hood member 104 by supports 108. Preferably, a base member 110 is attached to the bottom of the center rib 102 and includes a raised lip 111 around its periphery. The base member 110 is configured to support the bottoms 28 and 30 of the first and second containers 12 and 14.

Preferably, the holder assembly 100 is made from a polymeric material. In the preferred embodiment, the center rib 102, the hood 104 and the living hinge 106 are molded from polypropylene as a unitary assembly. However, it is understood by those of ordinary skill in the art from the present disclosure that the holder assembly 100 can be from other suitable polymeric materials, or may be made from sheet metal using separate pieces for the center rib 102, the hood 104 and the hinge 106, which are fastened together in a subsequent manufacturing operation, if desired. Additionally, straps (not shown) may be provided to secure the first and second containers 12 and 14 to the holder assembly 100. In the preferred embodiment, a handle 112 in the form of a loop is attached to the center rib 102 on the holder assembly 100.

Figure 9:
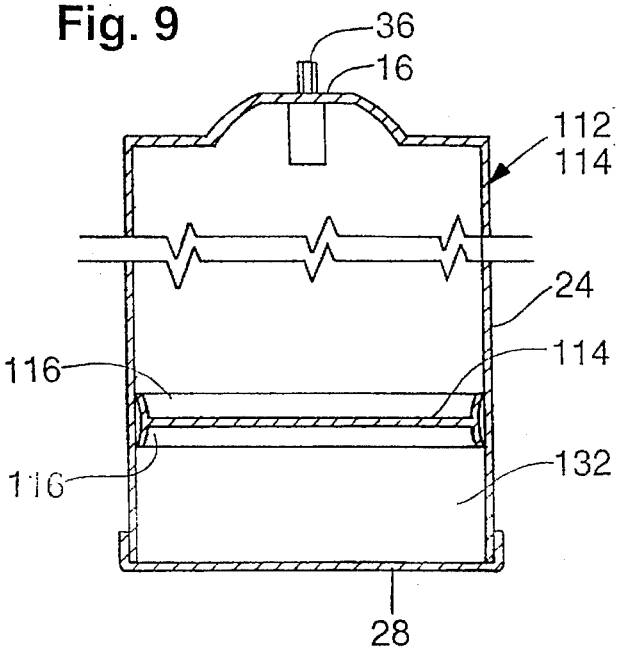
FIG. 9 is an alternate embodiment of a pressurized container in accordance with the present invention.

Referring now to FIG. 9, an alternative embodiment of the first and second pressurized containers 12 and 14 is shown. The alternative embodiment of the container 112 is similar to the first and second containers 12 and 14, as described above, except that the container 112 does not include a bladder. A piston 114 having sealing flanges 116 is disposed inside the container 112. The sprayable substance is held on one side of the piston 114. The second pressurized container (not shown) is constructed in a similar manner. Preferably, the sprayable substance is located above the piston, and a pressurized gas pocket 132 is located below the piston 114. However, it is understood by those of ordinary skill in the art from the present disclosure that in certain applications, the sprayable substance may be located below the piston 114 and the pressurized gas pocket is then located above the piston 114. A tube (not shown) extends from the valve assembly at the dispensing end of the container through the piston 114 to the bottom of the container, with the piston sealingly engaging both the container side wall and the tube. It is understood by those of ordinary skill in the art from the present disclosure that the type of pressurized container does not matter and the only requirement is to provide a tapable pocket of pressurized gas in both the first and second pressurized containers.

Having described the structure of the dispenser 10 in accordance with the present invention, a brief description of its operation follows with respect to FIGS. 1–6. The dispenser 10 is initially provided with the holder assembly 100, having the pressure equalization member 90 and the manifold member 40 attached thereto. The selector member 60 is rotatably disposed in the manifold member and the actuator 80 is attached to the selector member 60. First and second pressurized containers 12, 14 holding first and second sprayable substances (now shown), respectively, are provided. The hood member 104 with the attached manifold member 40 is pivoted upward from the position shown in FIG. 1, and a first pressurized container 12 is placed in a position and pressed against the uncompressed seal 94 of the pressure equalization member 90. As the seal 94 is compressed, the side wall 24 adjacent to the bottom 28 of the first container 12 comes into contact with the sharpened end of tube 92 of the pressure equalization member 90. A force is applied to the first container 12 causing the sharpened end of the tube 92 to puncture the side wall 24 to place the tube 92 in fluid communication with the pressurized gas pocket 32 beneath the bladder 20 in the first container 12. The uncompressed seal 94 on the opposite side of the center rib 102 from the first container 12 prevents the pressurized gas from escaping. The second container 14 is installed in a similar manner to the first container, placing the tube 92 of the pressure equalization member 90 in fluid communication between the pressurized gas pockets 32 and 34 in the first and second containers 12 and 14, respectively. An optional strap (not shown) may be fastened around the containers 12 and 14 in the holder assembly 100 to secure the containers in position.

The pressure equalization member 90 equalizes the gas pressure in the first and second pressurized containers 12 and 14. It is important that the pressure in each container 12 and 14 is approximately equal in order to achieve proportional mixing of the sprayable substances in the first and second containers 12 and 14. If the pressure varies, then instead of the sprayable material from each container 12, 14 being proportional to the size of the opening 62 provided at the juncture of the first and second passages 52 and 54 and the selector member 60, the amount of the first and second sprayable substances being dispensed would also be in proportion to the difference in pressure between the first and second containers 12, 14.

After the first and second containers are installed, the hood member 104 and the attached manifold member 40 are pivoted toward the dispensing ends 16, 18 of the containers 12 and 14 so that the first and second inlet openings 42 and 44 of the manifold member 40 contact the dispensing tubes 36 and 38 on the first and second containers 12 and 14, respectively. The first inlet opening 42 is aligned with the first dispensing tube 36 on the first container 12 and the second inlet opening 44 is aligned with the second dispensing tube 38 on the second pressurized container 14. The hood member 104 and the manifold member 40 are then pressed downward such that the first and second dispensing tubes 36 and 38 are pressed into close conforming engagement with the first and second inlet openings 42 and 44 of the manifold member 40. Based on the distance between the manifold member 40 and the hinge 106, the short movement required to open the valve assemblies 37 and 39 located at the dispensing ends 16 and 18 of each container 12 and 14 is approximately linear.

In order to dispense a mixture of the first and second sprayable substances in a desired proportion, the actuator arm 70 on the selector member 60 is adjusted to a desired position. If 100% of the first sprayable substance is desired, and 0% of the second sprayable substance, the arm 70 is adjusted such that the opening 62 in the selector member 60 is in a first position as shown in FIG. 4, where the first passage 52 is in fluid communication with the opening 62 of the selector member 60, and the second passage 54 is blocked by the selector member 60. If 0% of the first substance and 100% of the second substance are desired, the arm 70 may be adjusted such that the second passageway 54 is in fluid communication with the opening 62 in the selector member 60 and the first passageway 52 is blocked, as shown in FIG. 6. Any intermediate proportions of the two substances may be achieved by adjusting the selector member 60 such that the opening 62 is in fluid communication with both the first and second passages 52 and 54, as shown in FIG. 5. After the arm 70 is adjusted, the actuator 80 should be rotated relative to the selector member 60 such that the outlet opening 84 is oriented in the proper direction.

After the selector member 60 is properly positioned to achieve the desired mixture ratio, pressure is applied downwardly on the actuator 80, causing downward movement of the manifold member 40 and the hood member 104. The manifold member 40 displaces the dispensing tubes 36 and 38 of each container 12 and 14 equally causing the valve assemblies 37 and 39 in the dispensing ends 16 and 18 of the first and second pressurized containers 12 and 14 to open. As the valve assemblies 37, 39 open, the first and second sprayable substances pass through the first and second passages 52 and 54 in the manifold member 40 and into the opening 62 in the selector member in proportion to the size of the unblocked opening between the first and second passages 52 and 54 and the opening 62 in the selector member 60. The first and second sprayable substances are turbulently mixed in the selector member opening 62 due to the pressure in the containers 12 and 14 forcing the first and second sprayable substances out of the first and second containers 12 and 14 at a relatively high velocity. The mixture of the first and second sprayable substances is directed through the actuator outlet opening 84 toward the surface where the mixture of sprayable substances is to be applied. The proportionate mixing of the first and second sprayable substances can be varied with repeatability by using the arm 70 as previously noted.

In the event that the mixing proportion of the first and second sprayable substances in the first and second containers 12 and 14 is not equal, the proper proportion of each substance being dispensed is maintained due to the pressure equalization member 90 in fluid communication with the pressurized gas pockets 32 and 34 in the first and second pressurized containers 12 and 14.

When the supply of the first or second sprayable substance in the first or second container 12 or 14 is depleted, the hood member 104 and the attached manifold member 40 are rotated upwards such that the first and second inlet openings 42 and 44 are disengaged from the dispensing tubes 36 and 38 of the first and second pressurized container 12 and 14, respectively. The empty container is then removed by pulling the container away from the pressure equalization member, such that the tube 92 is released from the side wall 24, 26 of the container 12 or 14 being removed. The seal 94 adjacent to the container 12 or 14 which is being removed is uncompressed as the container 12 or 14 is removed and acts as a seal to prevent leakage of the pressurized gas in the container 12 or 14 which is not removed. A replacement container 12 or 14 which is filled with a first or second sprayable substance is then installed in the same manner as previously described.

If the pressure equalization member 190, as shown in FIG. 8, is utilized, the dispenser 10 is operated in the same manner except that the tube 192 must be partially into the valve 194 in each container 12 and 14, such that the openings 195 are sealed by the valve 194. After the tube 192 is partially inserted into each container 12 and 14, the containers are then pressed toward each other so that the tube 192 is fully inserted and fluid communication is established between the pressurized gas pockets 32 and 34 in each container. Additionally, the pressurized gas pockets 32 and 34 in each container 12 and 14 can be recharged by means of the valve 194 if the pressure in the gas pockets 32 and 34 is depleted before the contents are used up. This avoids the problem of leaky seals 94, and provides a fresh needle valve assembly 195 each time a replaceable container 12 or 14 is replaced. For replacement of a container 12 or 14 upon depletion, the tube 192 must be partially withdrawn from each container so that the openings 195 are blocked before either container is fully disengaged from the pressure equalization member 190.

Use of the alternate container 112, shown in FIG. 9, would be transparent to the user, and the use of the dispenser 10 would be substantially the same as outlined above.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An apparatus for dispensing two sprayable substances in a user selectable ratio comprising:

a first pressurized container for holding a first sprayable substance, the container including a dispensing end;

a second pressurized container for holding a second sprayable substance, the second container including a dispensing end;

a manifold member having first and second inlet openings and an outlet opening, the inlet openings being configured for removably receiving the dispensing ends of the first and second pressurized containers, the manifold member including two passages, a first passage being in fluid communication between the first inlet opening and the outlet opening, and a second passage being in fluid communication between the second inlet opening and the outlet opening;

a selector member in fluid communication with the first and second passages in the manifold member, the selector member having a single opening of a predetermined size and a predetermined shape extending therethrough, the selector member being selectably rotatable with respect to the outlet opening in the manifold member from a first position, in which the selector member opening is in fluid communication with the first passage with the outlet of the second passage being blocked by the selector member, through a plurality of intermediate positions, in which the opening of the selector member is in fluid communication with portions of both passages with the remaining portions of the outlets of both of the passages being blocked by the selector member, to a second position, in which the opening of the selector member is in fluid communication with the second passage and the first passage is blocked by the selector member; and an actuator having an inlet opening in communication with the selector member and an outlet opening whereby, upon activation of the actuator a predetermined measure of sprayable substance is dispensed from the apparatus with the ratio of the dispensed substance being selectively variable by the user from one hundred percent of the first sprayable substance and zero percent of the second sprayable substance when the selector member is in the first position to zero percent of the first sprayable substance and one hundred percent of the second sprayable substance when the selector member is in the second position to any desired ratio therebetween when the selector member is in an intermediate position.

2. The apparatus as recited in claim 1, wherein the first pressurized container further includes a first bladder, and the first sprayable substance is held within the first bladder; and the second pressurized container further includes a second bladder, and the second sprayable substance is held within the second bladder.

3. The apparatus as recited in claim 1, wherein the first pressurized container further includes a first moveable piston, and the first sprayable substance is held on one side of the first piston; and the second pressurized container further includes a second moveable piston, and the second sprayable substance is held on one side of the second piston.

4. The apparatus as recited in claim 1, wherein the first pressurized container further includes a first moveable piston, and the first sprayable substance is held within the first container above the first piston; and the second pressurized container further includes a second moveable piston, and the second sprayable substance is held within the second container above the second piston.

5. The apparatus as recited in claim 1 further comprising a pressure equalization member located between the first container and the second container, the pressure equalization member including a passage which is in fluid communication with the first and second containers.

6. The apparatus as recited in claim 5, wherein the pressure equalization member is comprised of a tube having two ends, each end having a pointed tip for penetrating a side of the first and second containers; and a seal disposed on the tube.

7. The apparatus as recited in claim 5 further comprising a holder assembly including a center rib, the pressure equalization member being mounted on the center rib; and a hood member, pivotally attached to the center rib, the manifold member being attached to the hood member.

8. An apparatus for dispensing two substances in a user selectable ratio comprising:

a first pressurized container having a dispensing end;

a second pressurized container having a dispensing end;

a manifold member including;

first and second inlet openings and an outlet opening, the first and second inlet openings being configured for removably receiving the dispensing ends of the first and second containers, respectively, a first passage being in fluid communication between the first inlet opening of the manifold and the outlet opening of the manifold, and a second passage being in fluid communication between the second inlet opening of the manifold and the outlet opening of the manifold;

a selector member in fluid communication with the outlet opening of the manifold;

an opening of a predetermined size extending through the selector member, such that the selector member is rotatably positionable relative to the manifold member from a first position, in which the selector member opening is in fluid communication with the first passage with the second passage being blocked by the selector member, through a plurality of intermediate positions, in which the opening of the selector member is in fluid communication with portions of both the first and second passages with the remaining portions of the first and second passages being blocked by the selector member, to a second position, in which the opening of the selector member is in fluid communication with the second passage and the first passage is blocked by the selector member; and an actuator having an inlet opening in fluid communication with the selector member.

* * * * *